United States Patent [19]

Thuries

[11] Patent Number: 4,521,657

[45] Date of Patent: Jun. 4, 1985

[54] CIRCUIT BREAKER WITH INCORPORATED CURRENT TRANSFORMER

[75] Inventor: Edmond Thuries, Pusignan, France

[73] Assignee: Alsthom Atlantique, Paris, France

[21] Appl. No.: 487,472

[22] Filed: Apr. 22, 1983

[30] Foreign Application Priority Data

Apr. 22, 1982 [FR] France ..... 82 06906

[51] Int. Cl.[3] ..... H01N 33/59

[52] U.S. Cl. ..... 200/148 R; 200/144 R; 200/148 A; 200/148 B

[58] Field of Search ..... 200/148 R, 148 A, 148 B, 200/148 D, 144 R

[56] References Cited

U.S. PATENT DOCUMENTS 3,114,815 12/1963 Easley et al. ..... 200/148 R
3,935,408 1/1976 Taylor ..... 200/148 B

FOREIGN PATENT DOCUMENTS 1248136 8/1967 Fed. Rep. of Germany ... 200/148 R

*Primary Examiner*—Robert S. Macon
*Attorney, Agent, or Firm*—Sughrue, Mion, Zinn, Macpeak & Seas

[57] ABSTRACT

The circuit breaker comprises: a stand (1) at ground potential; a first insulating column (2) supported by said stand and filled with a highly dielectric gas; a second insulating column (4) coaxially supported by said first insulating column, said second insulating column serving as a cut-out chamber and including moving contacts (6) connected to a first current terminal (8) and associated with moving contact drive means (3), and fixed contacts (10) connected to a second current terminal (12). Said second column supports a third insulating column (13) which is coaxial with said first and second columns. At least one magnetic circuit and secondary winding (14A–14D) of a current transformer are disposed around said third column in the neighborhood of its connection to said second column. The primary circuit of said current transformer is constituted by a conductor (11) connecting said fixed contacts to said second terminal. An anti-discharge screen (26) is disposed inside said third column level with the transformer and electrically connected to ground via the junction between said second and third columns (15) and via a metal tube (27) which extends from said junction substantially down to ground level and which also serves to house connections (28) between said secondary winding and measuring apparatus.

8 Claims, 3 Drawing Figures

CIRCUIT BREAKER WITH INCORPORATED CURRENT TRANSFORMER

The present invention relates to a circuit breaker having its housing under tension and modified to receive one or more current transformers.

BACKGROUND OF THE INVENTION

It is easy to incorporate current transformers in metalclad circuit breakers located in a grounded tank provided with feed-throughs; the turns are then placed at the foot of each feed through; however this is not possible for circuit breakers having their housings under tension, since the low tension windings then need full tension insulation from the high tension windings; in such cases, the current transformer is kept separate from the circuit breaker. There are often occasions when it would be convenient to link the current transformer to the circuit breaker, even if the circuit breaker needs to be modified.

SUMMARY OF THE INVENTION

The present invention provides a circuit breaker with incorporated current transformer, the circuit breaker comprising: a stand at ground potential; a first insulating column supported by said stand and filled with a highly dielectric gas; a second insulating column coaxially supported by said first insulating column, said second insulating column serving as a cut-out chamber and including moving contacts connected to a first current terminal and associated with moving contact drive means, and fixed contacts connected to a second current terminal; the improvement wherein said second column supports a third insulating column which is coaxial with said first and second columns, and wherein at least one magnetic circuit and secondary winding of a current transformer are disposed around said third column in the neighborhood of its connection to said second column, the primary circuit of said current transformer being constituted by a conductor connecting said fixed contacts to said second terminal; and an anti-discharge screen being disposed inside said third column level with the current transformer and electrically connected to ground via the junction between said second and third columns and via a metal tube which extends from said joint substantially down to ground level and which also serves to house electrical connections between said secondary winding and measuring apparatus.

In one embodiment, said magnetic circuit and said secondary winding are supported on a plate which is inserted between said second and third columns and which is connected to each of them by respective sealing rings, said plate also serving inside the columns to support said anti-discharge screen.

In another embodiment, said magnetic circuit, said secondary winding, and said anti-discharge screen are supported by a cylindrical metal housing which is coaxial with said second and third columns and which is disposed in between them.

Advantageously, a gas circulation pipe discharges into said housing in such a manner as to cause said gas to circulate through said housing and through said second and first insulating columns.

Heating means may be inserted in said gas circulation pipe to heat the gas, whereby enabling out-door operation in cold weather when using $SF_6$ as the dielectric gas.

The invention is also applicable to circuit breakers having plurality of cut-out chambers connected in series.

BRIEF DESCRIPTION OF THE DRAWINGS

Embodiments of the invention are described by way of example, with reference to the accompanying drawings, in which.

MORE DETAILED DESCRIPTION

Figure 1:
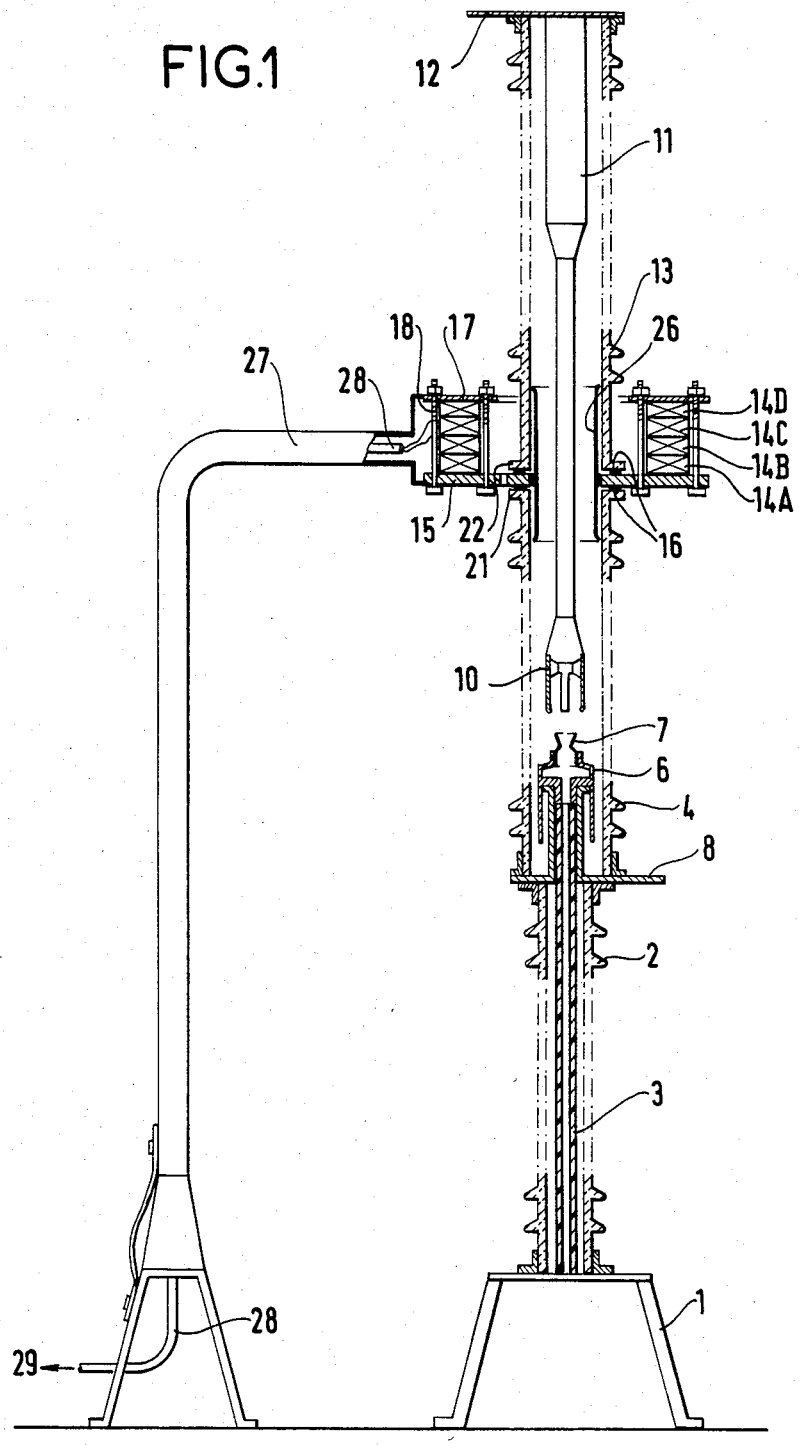
FIG. 1 is an axial section through a first circuit breaker embodying the invention.

The circuit breaker shown in FIG. 1 includes a grounded stand 1 with a first insulating support column 2 mounted on the stand 1. The column 2 is made of ceramics, is hollow and is filled with a highly dielectric gas such as sulphur hexafluoride ($SF_6$), and has an insulating rod 3 passing therealong for transmitting motion to the moving contacts of a cutout chamber.

The cut-out chamber comprises a second column 4 which is coaxial with the first column 2 and which carries said moving contacts 6 and blast nozzel 7. A connection terminal 8 is provided at the base of the cut-out chamber and is electrically connected to the moving contacts.

In the cut-out chamber, there are also fixed contacts 10 connected via a tubular contact 11 to a second terminal 12 provided at the top of the circuit breaker.

In a conventional circuit breaker, the top terminal 12 is placed at the top of the cut-out chamber.

However, in accordance with the invention, a third insulating column 13 is mounted on top of the cut-out chamber 4, and the terminal 12 is at the top of the third column 13.

A current transformer comprising four secondary windings 14A, 14B, 14C, and 14D wound on magnetic circuits, is located at the joint between the second and third columns 4 and 13.

The windings are carried by a metal plate or disk 15 which penetrates between said columns and which is sealed to each of them by respective sealing rings 16. The windings are held in place by an upper plate 17 and tie rods 18 which serve to clamp the windings between the disk 15 and the plate 17.

The second and third columns are preferably terminated by respective flanges 21 and 22 for holding the disk 15.

A tubular metal anti-discharge screen 26 is disposed inside the columns 4 and 13 and extends at least as far as the windings. The screen serves to make the electric field more uniform, and is held at ground potential by the support disk 15 and a metal conduit 27 which also serves to protect wiring 28 for connecting the windings to measuring apparatus (not shown). The secondary windings and the magnetic circuits are embedded in material providing protection against wet and damp, and water drain outlets are provided in the disk 15.

The structure described above differs from a conventional circuit breaker constituted by a stand 1, an insulating support column 2 and a cut-out chamber 4, by the addition of the third insulating column 13. This third column is no more onerous than the insulating support which would normally have had to be provided for an individual current transformer external to the circuit breaker. It is not necessary to insulate the secondary windings from the high tension and from the wiring to measuring apparatus. Further, the bulk of the equipment is considerably reduced in comparison to conventional metal-clad equipment housed in a grounded tank, and reduced volume can be a considerable advantage.

On the deficit side, the circuit breaker is taller than it would otherwise have been, but this is rarely a drawback.

Further, such an arrangement makes it possible to use a capacitance voltage probe using the conductor 11 and the screen 26 as a capacitive voltage divider, in which case the screen 26 must be insulated from the disk 15.

The second insulating column 4 containing the switch gear may be oval in section, however the third column 13 should be of circular section and of minimal diameter. In order to enable the windings to be easily removed, their inside diameter is greater than the outside diameter of the fins on the third column 13, and even though it is necessary for the average diameter of the magnetic circuits to be less than that in order to increase the measuring accuracy of the transformer, removing the top column 13 is an acceptable penalty to pay for changing the magnetic circuits, since they require changing very rarely.

Figure 2:
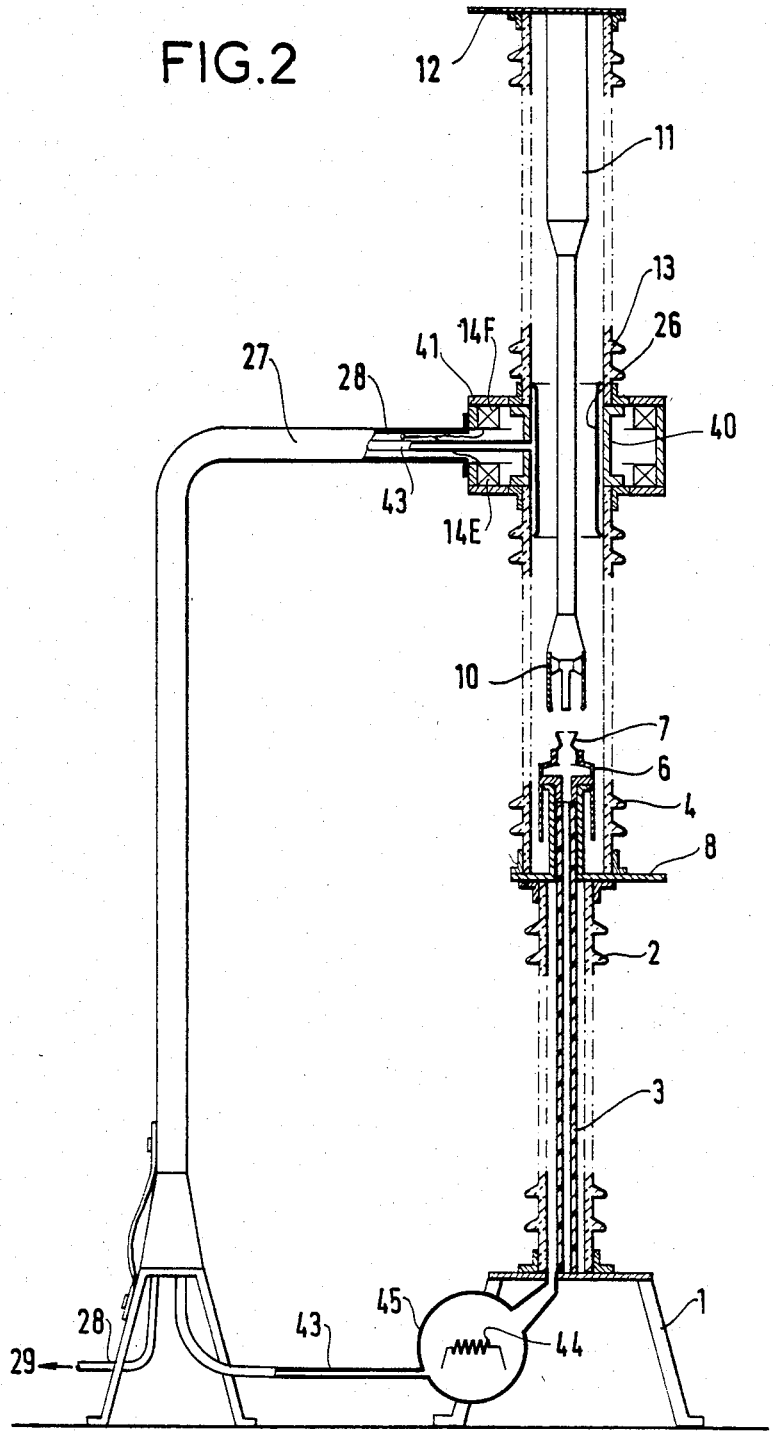
FIG. 2 is an axial section through a variant circuit breaker.

FIG. 2 shows a variant in which components common to both FIGS. 1 and 2 have the same reference numerals. The main difference is a metal sleeve 40 which is interposed in between the second and the third insulating columns 4 and 13.

The sleeve 40 serves a support for a housing 41 in which two windings 14E and 14F are lodged. The housing is connected to the metal conduit 27 which serves both to protect the connections 28 leading to measuring apparatus (not shown), and to protect a pipe 43 which connects the inside of the sleeve 41 with the inside of the base of the first column 2. The pipe 43 thus serves to circulate gas, which may be heated by an electrical resistance 44 housed in a chamber 45.

The heating may be necessary for a circuit breaker located out of doors at temperatures cold enough to cause $SF_6$ gas to condense. The heating enables the $SF_6$ pressure to be raised, thereby improving current breaking.

Conversely, the same pipe can be used for forced circulation to cool the conductors in very hot weather.

Figure 3:
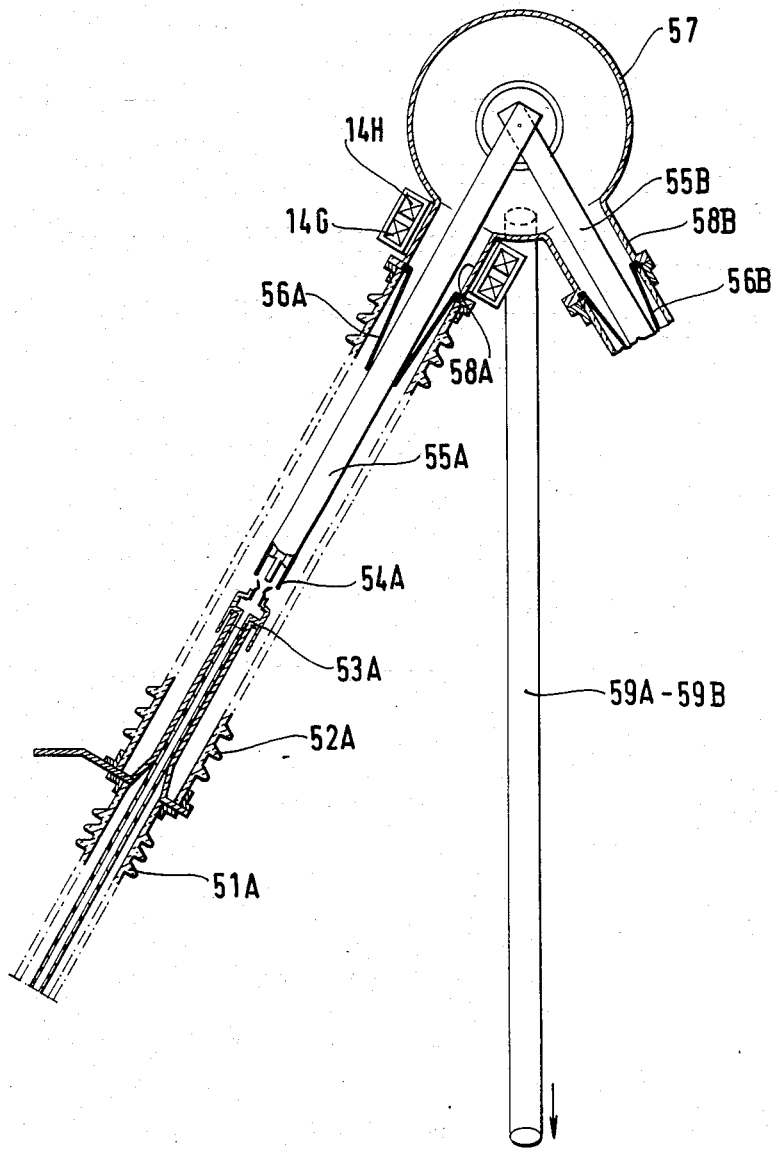
FIG. 3 is a section through a portion of a two-chamber circuit breaker.

FIG. 3 is a section through a portion of a two-chamber circuit breaker, in which the cut-out chambers are connected in series.

The chambers are disposed along the branches of an upside down V in a vertical plane. Each branch comprises: an insulating column 51A (51B); and a cut-out chamber 52A (52B) having moving contacts 53A (53B), and fixed contacts 54A (54B) which are extended by conductors 55A (55B) that are held by insulating cones 56A (56B).

A metal housing common to both branches encloses the point of the V where the conductors 55A and 55B are interconnected. The housing is spherical and is connected to the columns 52A and 52B by respective sleeves 58A and 58B around at least one of which the magnetic circuits and the secondary windings 14G and 14H of a current transformer are disposed.

Two conduits 59A and 59B are also arranged along respective branches of an upside down V occupying a plane perpendicular to that of the cut-out chambers, and meeting at the same spherical housing 56 which is thereby connected to ground. One of the conduits 59A and 59B serves to protect the wires coming from the windings, and/or to convey a gas circulation pipe. The entire assembly forms a tetrapod which is rigid and stable.

We claim:

1. A circuit breaker with incorporated current transformer, the circuit breaker comprising: a stand at ground potential; a first insulating column supported by said stand and filled with a highly dielectric gas; a second insulating column coaxially supported by said first insulating column, said second insulating column serving as a cut-out chamber and including moving contacts; a first current terminal connected to said moving contacts; moving contact drive means operatively associated with said moving contacts; fixed contacts; and a second current terminal connected to said fixed contacts; the improvement comprising a third insulating column supported by said second column and being coaxial with said first and second columns, and at least one magnetic circuit and secondary winding of a current transformer being disposed around said third column in the vicinity of its connection to said second column, the primary circuit of said current transformer being constituted by a conductor connecting said fixed contacts to said second terminal; and an anti-discharge screen being disposed inside said third column level with the current transformer and wherein a metal tube extends from the junction between said second and third columns and substantially down to ground level and which also serves to house electrical connections between said secondary winding and a measuring apparatus electrically connecting said anti-discharge screen to ground.

2. A circuit breaker according to claim 1, wherein said magnetic circuit and said secondary winding are supported on a plate which is inserted between said second and third columns and which is connected to each of them by respective sealing rings, said plate also serving inside the columns to support said anti-discharge screen.

3. A circuit breaker according to claim 1, wherein said magnetic circuit, said secondary winding and said anti-discharge screen are supported by a cylindrical metal housing which is coaxial with said second and third columns and which is disposed in between them.

4. A circuit breaker according to claim 3, wherein a gas circulation pipe discharges into said housing in such a manner as to cause said gas to circulate through said housing and through said second and first insulating columns.

5. A circuit breaker according to claim 4, wherein heating means are inserted in said gas circulation pipe.

6. A circuit breaker with incorporated current transformer, said circuit breaker having two cut-out chambers connected in series and disposed in the form of two identical sloping assemblies meeting at an apex of an upside down V occupying a first vertical plane, each of said assemblies comprising a first insulating column, a second insulating column serving as a cut-out chamber, both fixed and moving contacts contained in said cut-out chamber, the improvement wherein the fixed contacts are extended by conductors which meet at said apex inside a metal housing common to both assemblies and means connecting said conductors in a sealed manner to both of said cut-out chambers, said housing including at least one cylindrical portion surrounding said conductors and at least one magnetic circuit and secondary winding of a current transformer being placed around said cylindrical portion, a metal tube which also serves to housing electrical connections between said secondary winding and a measuring apparatus electrically connecting said housing to ground.

7. A circuit breaker according to claim 6, wherein said tube also serves to circulate insulating gas between said housing and the feet of said first insulating columns.

8. A circuit breaker according to claim 7, wherein heating means are inserted in said gas circulation path.

* * * * *